US005478081A

United States Patent [19]

Terry

[11] Patent Number: 5,478,081

[45] Date of Patent: Dec. 26, 1995

[54] GOLF SWING ALIGNMENT TEMPLATE

[76] Inventor: Terence R. Terry, 378 Flittner Cir., Thousand Oaks, Calif. 91360

[21] Appl. No.: 313,780

[22] Filed: Sep. 28, 1994

Related U.S. Application Data

[63] Continuation-in-part of Ser. No. 225,707, Apr. 11, 1994, abandoned.

[51] Int. Cl.[6] ..... A63B 69/36

[52] U.S. Cl. ..... 273/187 A

[58] Field of Search ..... 273/187 R, 187 A, 273/186.1, 187.6

[56] References Cited

U.S. PATENT DOCUMENTS 5,108,106 4/1992 Cook ..... 273/187 R 5,397,121 3/1995 Gipson et al. ..... 273/187 R X

*Primary Examiner*—George J. Marlo

*Attorney, Agent, or Firm*—Jack C. Munro

[57] ABSTRACT

A golfer's stance alignment tool in the form of a sheet material plate which is to be placed on the ground directly in front of the feet of the golfer during the time that the golfer is practicing the golf swing. The inner edge of the plate has recesses for positioning the golfer's feet therein. The outer linear edge of the plate includes a rounded protrusion that is to be used by the golfer to aligningly position the head of the golfer prior to initiating the golf swing and during the golf swing. The flat plate includes a straight horizontal line indicating to the golfer the directional path and movement of the golf club when making the golf swing. The template also includes a circle representation of a golf ball located between intersecting pairs of vertical and horizontal lines to indicate to the user a golf ball placement area.

10 Claims, 1 Drawing Sheet

GOLF SWING ALIGNMENT TEMPLATE

REFERENCE TO PRIOR APPLICATION

This application is a continuation-in-part of patent application Ser. No. 08/225,707 filed Apr. 11, 1994 by the present inventor, entitled PORTABLE TEMPLATE THAT IS A TEACHING AND PRACTICE DEVICE WHICH PROVIDES GUIDANCE IN GOLF SHOT ALIGNMENT IN BALL ADDRESS POSITION TO THE GOLFER now abandoned.

BACKGROUND OF THE INVENTION

1) Field of the Invention

The field of this invention related to a device for aiding and training of a golfer in positioning himself or herself relative to the golf ball, obtaining the proper stance and assisting in the making of the proper swing on the ball.

2) Description of the Prior Art

The game of golf is played by millions of people throughout the world. There are of course inexperienced players as well as experienced players. Both inexperienced and experienced players are all interested in improving their game. The most common way that such players improve their game is by taking lessons from golf professionals. Such lessons generally are a definite improvement to one's game. However, golf instruction is expensive and time consuming. Accordingly, most people limit the amount of time actually spent with a golf professional. There is a need to utilize some type of instructional apparatus that the player can use during the time that he or she is practicing and not in the company of the golf professional.

In the past there have been developed numerous types of devices that assist the golfers in improving their game. These devices are generally designed to assist the golfer in making of the golf swing. If the golfer makes the correct golf swing, then the golfer can hit a shot that is straight and long. If the golfer is able to consistently repeat that golf swing, then each time the golf ball is struck, it will go almost precisely the same direction and distance. This is generally the ultimate objective of every individual involved with playing the game of golf.

In the past one type of device that has been used to assist golfers in making of a golf swing is to utilize a mat upon which is inscribed alignment indicia that is to be used by the golfer to assist the golfer in making of the golf swing. Most of the mats of the prior art are designed to be permanent fixtures generally to be located in a driving range facility. Portable mats have been known but have not been designed to be of a size to facilitate portability and usage by the golfer in any environment whether it be on a golf range or on the golf course.

One of the objectives of the present invention is to construct an alignment tool for a golfer that can be used in any environment where a golf swing is able to be performed which assists the golfer in making of the correct stance and the correct swing on the golf ball.

Another objective of the present invention is to construct an alignment template that can be manufactured relatively inexpensively and therefore sold to the consumer at a relatively inexpensive price.

SUMMARY OF THE INVENTION

The alignment tool of the present invention constitutes a sheet material plate which is to be placed on the ground directly in front of the feet of the golfer during the time that the golfer is practicing the golf swing. The inner edge of the plate has recesses to assist the golfer in making of the correct stance when swinging of the golf club. The outer edge of the plate includes a rounded protrusion that is to be used by the golfer to aligningly position with the head of the golfer prior to initiating of the golf swing and during the making of the golf swing. The flat plate includes a straight horizontal line indicating to the golfer the directional path and movement of the golf club when making the golf swing. The template also includes a representation of a golf ball to indicate to the user the location of the golf ball according to the position of the golfer's feet. Actually there is defined a golf ball placement area of which the representation of the golf ball is part with this placement area to be used according to the different clubs that the golfer would be using with the golf ball occupying a slightly different position for each club.

DETAILED DESCRIPTION OF THE PREFERRED EMBODIMENT

Figure 1:
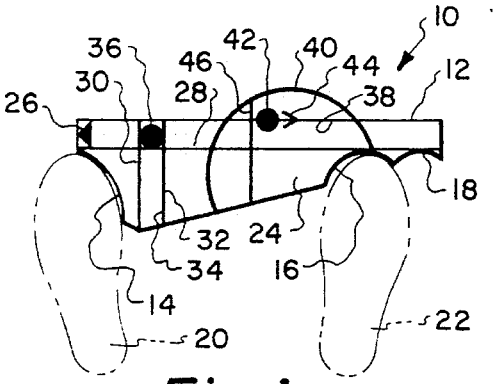
FIG. 1 is a top plan view of the golf alignment template of the present invention showing its arrangement relative to the feet of the golfer where the golfer is small in stature.
Figure 2:
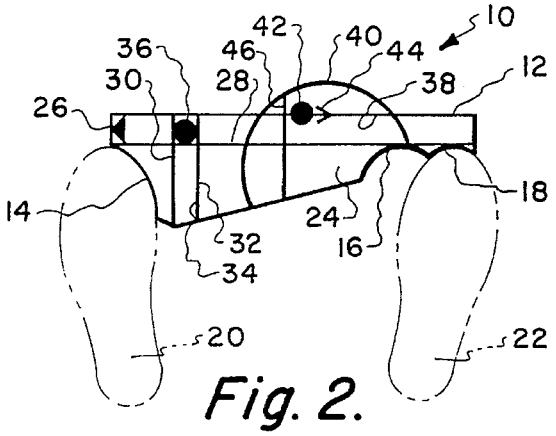
FIG. 2 is a view similar to FIG. 1 but showing the positioning of the feet of the golfer where the golfer is larger in stature.
Figure 3:
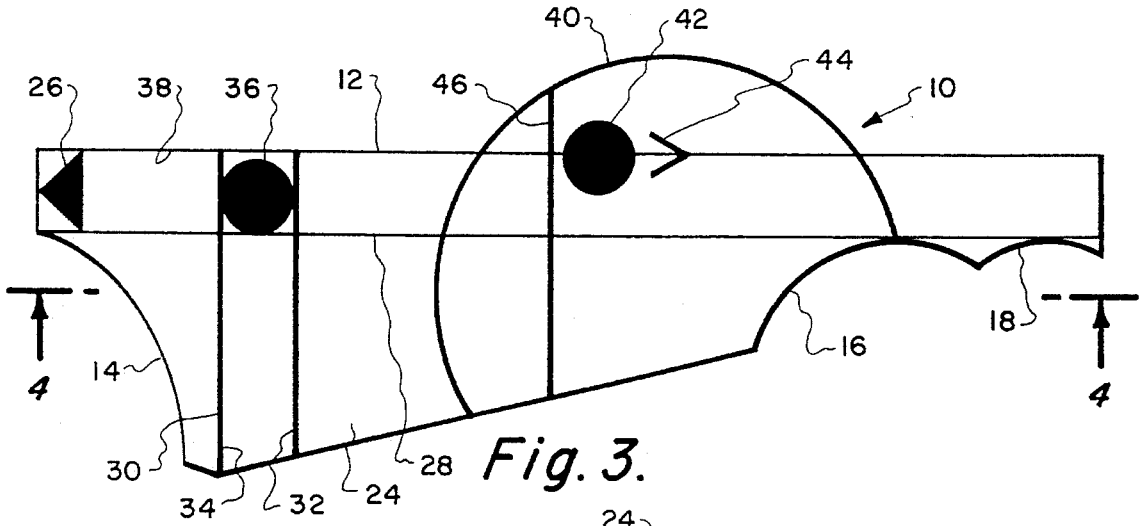
FIG. 3 is a top plan view of the golf alignment template of the present invention.
Figure 4:
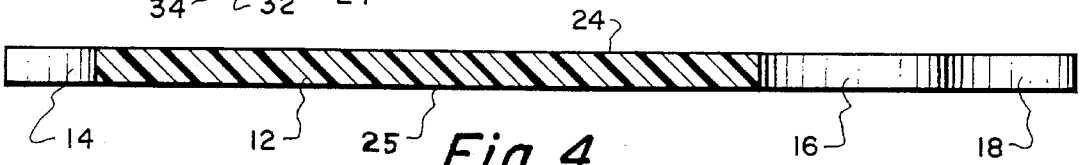
FIG. 4 is a cross-sectional view taken along line 4—4 of FIG. 3.

Referring in particular to FIGS. 1 to 4 of the drawing there is shown the golf alignment template 10 of this invention. This golf alignment template 10 is to be constructed of sheet material defining a plate 12. The plate 12 has an inner edge which includes recesses 14, 16 and 18. Recess 14 is to connect with the left foot 20 of a right handed golfer as is shown in FIGS. 1 and 2. Recess 16 is to connect with the right foot 22 of the golfer as is shown in FIG. 1. If the golfer is larger in stature, the right foot 22 is to connect with the recess 18. The recesses 14, 16 and 18 are configured to align with the feet 20 and 22 as is depicted in FIGS. 1 and 2 of the drawing. Typically, a golfer that is about five feet eight inches in height would use recess 16 with his right foot 22. If the golfer was over six feet tall, then it would be common that the golfer would use recess 18 as is shown in FIG. 2.

The outer edge of the plate 12 includes a rounded protrusion 40. The function of the rounded protrusion 40 is to be in direct vertical alignment with the head (not shown) of the golfer when the golfer is occupying the position shown in FIGS. 1 and 2. The template shown in FIGS. 1 and 2 is intended for usage by a right-handed golfer making a right-handed swing. Within the protrusion 40 there is located a circle 42 with this circle to align with the left eye of the golfer.

Located directly next to the circle 42 is a chevron 44. This chevron 44 provides an indicator to the golfer that, when initiating the swing, to first begin the swing by turning of the golfer's head slightly in the rearward direction. It is the function of the chevron 44 to be a reminder to the golfer to make this initial movement when making of the golf swing.

The circle 42 and the chevron 44 are inscribed or otherwise formed on the upper surface 24 of the plate 12. The indicia of which circle 42 and chevron 44 are a part on the surface 24 can be formed thereon by being etched, embossed, screened, drawn, printed or painted directly on the upper surface 24. The bottom surface 25 is intended to rest directly on the ground or other supporting surface on which the golfer happens to be standing.

The plate 12 is intended to be made of a sturdy but yet flexible material. Desirable types of material would be a high density foam rubber, fabric, vinyl material, plastic and wood. The plate 12 can be of any desirable thickness from ⅛" to a couple inches. However, the preferred thickness is generally about one inch.

Inscribed on the upper surface 24 is a straight line 28 with this line generally referred to as horizontal. The horizontal line 28 is parallel to the outer edge of the plate 12. In between the outer edge of the plate 12 and the line 28 is defined a space 38. It is the function of that space to indicate to the golfer the path of movement of the golf club as it is to be swung through the impact area with the golf ball (not shown).

Within this impact area 38 there is located a representation of a golf ball 36. This representation 36 is to be in alignment with the golf ball (again not shown) that is to be struck when the golfer is using a driver club. On the forward side of the golf ball representation 36 is a vertical line 30. Rearwardly of the golf ball representation 36 is a second vertical line 32. In between the vertical lines 30 and 32 is located an area 34. This area 34 is to assist the user in proper locating of the golf ball that is to be struck with this golf ball to be in alignment with the area 34. As the user swings with different clubs such as a 2 wood, 3 wood, 4 wood, 2 iron, 3 iron, all the way to wedge, the golf ball that is to be struck will be progressively moved to where at the wedge position the golf ball will be located in alignment with vertical line 46. In between lines 30 and 46, this is referred to as the ball placement area.

Within the area 38 at the leading edge of the plate 12 there is located an arrow 26. It is the function of the arrow 26 to give an indication to the golfer that this is the direction of movement of the golf club when making of the golf swing.

Figure 5:
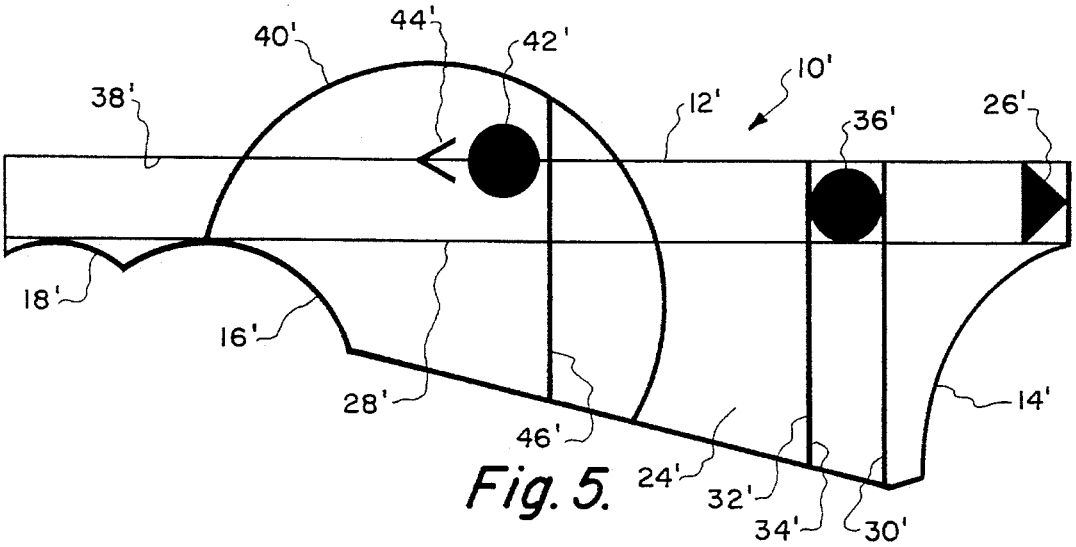
FIG. 5 is a top plan view of a modified form of golf alignment template that is designed for a left-handed golfer whereas the golf alignment template of FIG. 3 is designed for a right-handed golfer.

Referring in particular to FIG. 5, there is shown a template 10' that is designed for a left-handed golfer. Like numerals have been utilized to refer to like parts when comparing the template 10' with the template 10. The template 10' is formed of a plate 12' the inner edge of which has foot locating recesses 14', 16' and 18'. Formed within the upper surface 24' of the plate 12 is a line 28' with an area 38' being located between the outer edge of the plate 12 and the line 28'. The plate 12 includes the rounded protrusion 40'. Inscribed within the rounded protrusion 40' is a circle 42' and a chevron 44'. Circle 42' is for alignment with the right eye of the golfer. Also inscribed within the rounded protrusion 40' is a vertical line 46' which defines the rearwardmost point of the ball placement area with the forward most point being defined by the vertical line 30'. Located directly adjacent the vertical line 30' and within the space 38' is a ball representation 36'. Located just after the ball representation 36' is a vertical line 32' with a space 34' being located between the vertical lines 30' and 32'. Inscribed also at the leading edge of the template 10' is an arrow 26'.

The plate 10 or plate 10' is to be placed on the ground in such a manner that the arrow 26 or 26' is pointing in the direction of the golf shot that is to be taken. All the lines and areas of the template 10 or 10' may be of any specific desired color so long as it is easily visible to the golfer using of the template 10 or 10'. When using of the template 10 or 10', the golf ball that is to be struck is to be positioned spaced from the template 10 or 10' that is comfortable to the golfer when making of the golf swing. If the golfer is swinging with a driver, the alignment of the golf ball that is to be struck is to be with the golf ball representation 36 and in alignment with the area 34, as previously mentioned. The golfer will visually determine when the template 10 or 10' is in correct alignment with the direction of the golf shot. The golfer also visually determines the alignment of the positioning of the golfer's head relative to the rounded protrusion 40 or 40' as well as the golfer visually determining the position of the golf ball relative to the template 10 or 10'. During the making of the golf shot, the position of the template 10 or 10' between the golfer's feet as well as its thickness physically and mentally assist in keeping the golfer's feet from moving during the golf swing. If the golfer's feet move in the middle of a golf swing, the template 10 or 10' will be repositioned which will immediately indicate to the user that feet movement occurred which should not occur. Therefore this calls attention for that golfer to not move his or her feet when making of a swing.

What is claimed is:

1. A golf swing alignment template to be used by golfers comprising:

a flat plate having upper and lower surfaces, an inner edge and a linear outer edge, said inner edge having a plurality of recesses, for positioning the feet of a golfer therein;

said flat plate including a rounded protrusion forming an integral portion of said outer edge and located generally between said recesses, said rounded protrusion to be used by the golfer user to aligningly position the head of the golfer user;

the upper surface of said flat plate including a straight horizontal line parallel to said linear outer edge for indicating to the golfer user the directional path of movement of a golf club when making a swing; and the upper surface of said flat plate including a pair of parallel, spaced apart vertical lines intersecting said horizontal line, and a circle representing a golf ball located between said vertical lines and between said linear outer edge and said horizontal line said representation to be aligned with a golf ball that is to be struck by the golfer user.

2. The golf swing alignment template as defined in claim 1 wherein:

there being a plurality of said recesses connectable with the trailing foot of the golfer user, the use of said recesses for said trailing foot being for the purpose of accommodating to different statures of golfer users.

3. The golf swing alignment template as defined in claim 1 wherein:

said flat plate including a directional arrow indicating the flight path of the golf ball when struck.

4. The golf swing alignment template as defined in claim 1 wherein:

a circle located within said rounded protrusion, said circle being for the purpose to align with an eye of the golfer user.

5. The golf swing alignment template as defined in claim 1 wherein:

said flat plate including a chevron located within said rounded protrusion, said chevron functioning as a reminder to the golfer user to initiate movement of the chin of the golfer user in the rearward direction upon initiating of a golf swing.

6. The golf swing alignment template as defined in claim 1 wherein:

said flat plate including a third vertical line which when used with said pair of vertical lines denotes the entire ball placement area for all clubs that would be used by the golfer user.

7. The golf swing alignment template as defined in claim 6 wherein:

said flat plate including a chevron located within said rounded protrusion, said chevron functioning as a reminder to the golfer user to initiate movement of the chin of the golfer user in the rearward direction upon initiating of a golf swing.

8. The golf swing alignment template as defined in claim 7 wherein:

a circle located within said rounded protrusion, said circle being for the purpose to align with an eye of the golfer user.

9. The golf swing alignment template as defined in claim 8 wherein:

said flat plate including a directional arrow indicating the flight path of the golf ball when struck.

10. The golf swing alignment template as defined in claim 9 wherein:

said flat plate including a plurality of recesses adapted to connect only with the trailing foot of the golfer user, the use of said plurality of recesses for said trailing foot being for the purpose of accommodating to different sizes of golfer users.

* * * * *